United States Patent [19]

O'Riley

[11] Patent Number: 4,607,850

[45] Date of Patent: Aug. 26, 1986

[54] LIGHTED SPORT ARTICLE FOR HAND TOSSING

[76] Inventor: Henry M. O'Riley, 88 N. Country Club Dr., Phoenix, Ariz. 85014

[21] Appl. No.: 779,472

[22] Filed: Sep. 25, 1985

[51] Int. Cl.[4] ..... A63B 65/10

[52] U.S. Cl. ..... 273/424; 429/97; 429/98

[58] Field of Search ..... 273/424, 425; 446/47, 446/262; 429/96–100; 368/204, 82–84, 88, 203, 291

[56] References Cited

U.S. PATENT DOCUMENTS

| | | | |
|---|---|---|---|
| 3,162,979 | 12/1964 | Garoogian | 446/242 |
| 3,695,938 | 10/1972 | Brodie | 429/98 |
| 3,745,049 | 7/1973 | Kaye | 429/97 |
| 3,786,246 | 1/1974 | Johnson et al. | 446/47 |
| 4,041,214 | 8/1977 | Salin | 429/98 |
| 4,135,324 | 1/1979 | Miller et al. | 273/424 X |
| 4,301,616 | 11/1981 | Gudgel | 446/47 |
| 4,307,538 | 12/1981 | Moffitt | 446/47 |

FOREIGN PATENT DOCUMENTS

| | | | |
|---|---|---|---|
| 55-74056 | 6/1980 | Japan | 429/98 |

*Primary Examiner*—Paul E. Shapiro

*Attorney, Agent, or Firm*—Joseph H. Roediger

[57] ABSTRACT

A sport article for tossing about by the hand of the user which includes light emitting diodes and a power source configured therein to provide uniform surface contours and not alter the flight characteristics thereof.

4 Claims, 7 Drawing Figures

LIGHTED SPORT ARTICLE FOR HAND TOSSING

BACKGROUND OF THE INVENTION

This invention relates to a sport article for hand tossing by the user and, in particular, to a sport article which is illuminated.

The flanged disc as a sport article to be tossed between participants has become a well known article for outdoor recreation. The ability of the user to alter the flight characteristics of the article by the manner of toss has provided great enjoyment to many. The aerodynamic properties of this type of article enable a single user to launch it into the wind and have it returned to him or, as is most often done, enjoy this recreational pursuit with another by alternating receiving and throwing.

While many variations of the flanged disc have been utilized, the article comprises essentially a central region having a curved depending flange thereabout and possessing an unbroken surface contour. This basic construction has provided an ability to vary the launch and flight characteristics of the article at the user's command.

In order to extend the hours of use of this type of sport article, attempts have been made to manufacture the device utilizing florescent materials. In addition, people have attempted to place batteries within the device, while securing a number of light emitting devices to the device which are connected to the battery by a plurality of structural ribs. The rib structure is provided on the underside of the article. However, these prior attempts to provide such a lighted sport article have been found to alter the aerodynamic properties of the article.

The placement of a spoked or rib construction on the underside of prior articles of this type has been found to make it difficult to effect a smooth toss due to the speed of rotation at which the article leaves the user's hand. Further the manner of receiving an article is every bit as important to the enjoyment of the participants, and the existence of a broken underside surface has limited the manner in which the article can be captured.

Accordingly, it is an object of the present invention to provide a sport article which is lighted to extend the hours of potential use while at the same time having the illuminating components contained within the article so as not to alter the surface contours of either the underside or the topside of the article. Also, the central region of the article is adapted to removably receive commercially-available individual power sources. The particular manner of construction of the article enables a user to readily replace spent power sources. Further, it is an object of this invention to provide a lighted sport object which can be readily manufactured and is relatively inexpensive while still providing the foregoing desired results.

SUMMARY OF THE INVENTION

The present invention relates to an illuminated sport article for use by individuals which comprises a disc having a central region and a perimetric region thereabout. A receiving means for a power source is located in the outer-surface of the central region. The power source is customarily a small cylindrical battery of the type commercially available.

The perimetric region has a circumferential flange means depending therefrom. The flange means includes both an inner-facing and an outer-facing surface, each of which may be curved or contoured in accordance with the desired aerodynamic properties. A plurality of light emitting means are positioned within the flange means proximate to the outer-facing surface thereof so as to provide illumination as the article is tossed from one participant to the other. The light emitting means are contained within the flange means at the outer-facing surface and provide a line of light as the article is rotated and tossed. In addition, the material used may be light-diffusive thereby illuminating the entire sport article.

The disc and flange means include electrical connection means extending between the receiving means for the power source located in the central region and the light emitting means positioned within the flange. When a power source is placed in the receiving means, electrical connection is effected between said source and the plurality of light emitting means contained within the flange means. Since the connection means are contained within the disc and flange, the outer and inner surfaces of the article are not altered or made discontinuous by the fact that the article contains means for self-illumination. Thus, the underside remains free for ready grasping and rotational tossing and further provides capability of receipt in the traditional means by the other participant. Further features and advantages of the invention will become more readily apparent from the following detailed description of a preferred embodiment when taken in conjunction with the accompanying drawings.

DESCRIPTION OF THE PREFERRED EMBODIMENT

Figure 1:
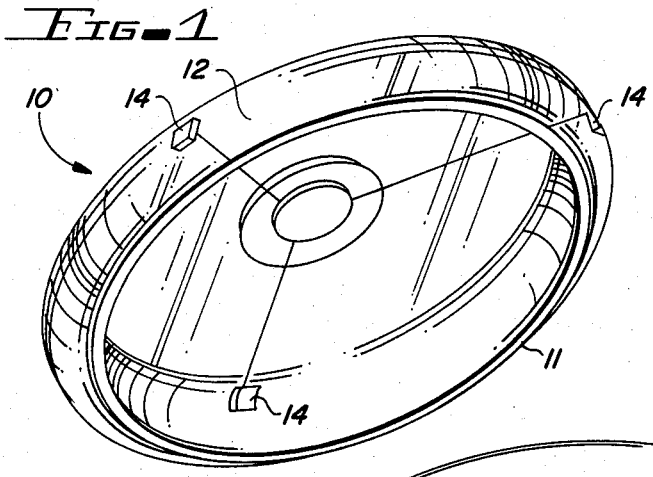
FIG. 1 is a view in perspective of a preferred embodiment of the invention.

Referring now to FIG. 1, sport object 10 designed for hand tossing by users is shown comprising a disc 11 having a central region and an encircling perimetric region. A curved flange 12 depends from the perimetric region of the disc and extends therearound. The flange has both inner-facing and outer-facing surfaces and, as shown, the outer-facing surface includes light emitting means one of which is identified as 14 in FIG. 1. The view in FIG. 1 is a perspective view showing the article as it travels through the air.

Figure 2:
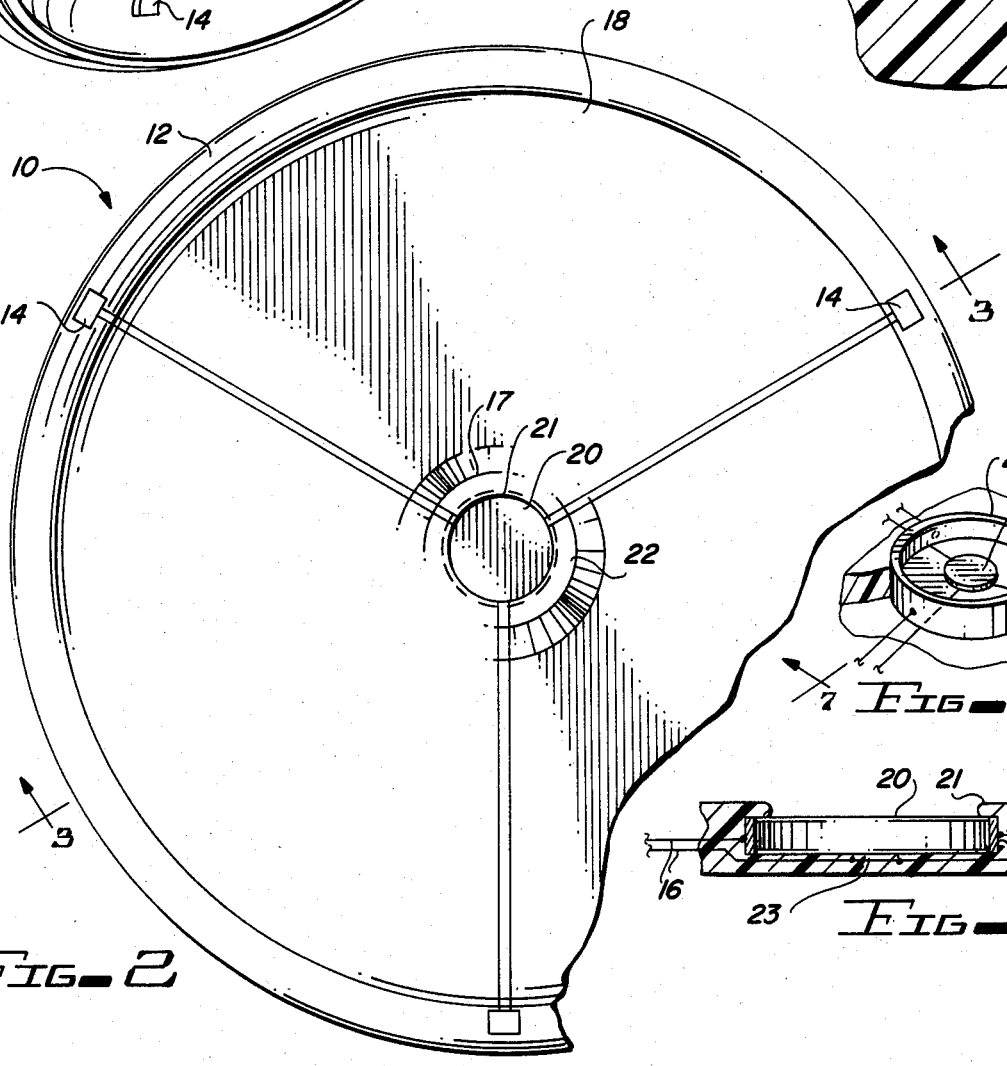
FIG. 2 is a plan view partially cut-away of the embodiment of FIG. 1.
Figure 3:
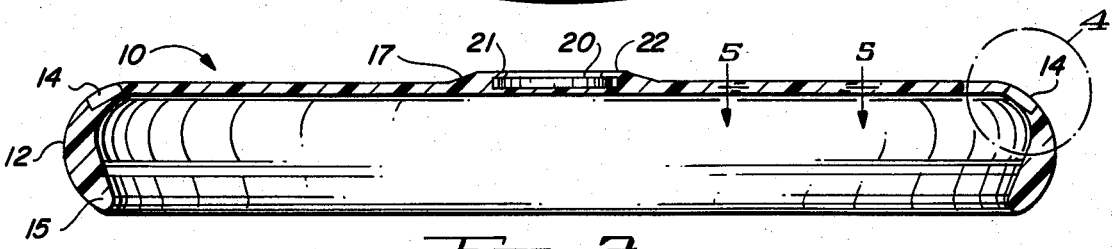
FIG. 3 is a side view in section taken along lines 3—3 of FIG. 2.

The plan view of FIG. 2 shows the central region 17 containing receiving means 22 which accommodates a power source 20 therein. The perimetric region 18 surrounding central region 17 has flange 12 depending therefrom. A plurality of light emitting sources 14, which in the embodiment shown are light emitting diodes, are incorporated within the flange and form a portion of the outer surface thereof. The constructional features of the invention are seen in FIG. 3 wherein the central region shown generally as 17 has a raised portion defining receiving means 22 into which battery 20 has been placed. The battery is a button-cell of the type now used in camera equipment.

The raised portion provided on the outer surface of the central region contains inwardly extending flange member 21 which removably retains the battery within the receiving means. The cross-sectional view emphasizes the embodiments utilization of a planar disc with an irregularly dimensioned curved flange 12 thereon. The thickness of flange 12 increases toward its grasping edge 15 The thickness and contour of both the disc 11 and the flange 21 may be altered as desired by the manufacturer without departing from the constructional features forming the subject invention.

Figure 4:
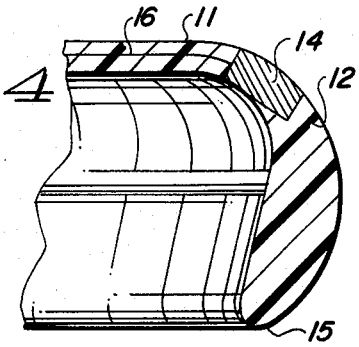
FIG. 4 is an exploded view of the region 4 shown in FIG. 3.
Figure 5:
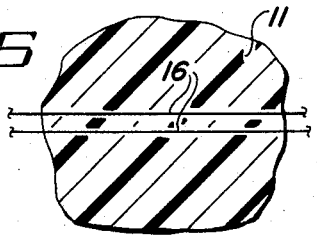
FIG. 5 is a sectional view between lines 5—5 of FIG. 3.

The light emitting diode 14 is shown formed as an integral part of flange 12 in FIG. 4. The conductive elements 16 are contained within the disc 11 and the adjacent portion of the flange 12. The light emitting diode is a two-terminal element which produces light upon the application of a voltage thereacross. Thus, a pair of conductive leads or wires is needed to make connection to each of the light emitting diodes contained within the flange. This is shown by the lead pair in FIG. 5.

Figure 6:
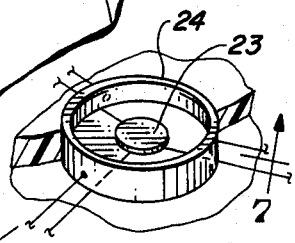
FIG. 6 is a view in perspective showing the power source contained in the central region of this embodiment of the invention.
Figure 7:
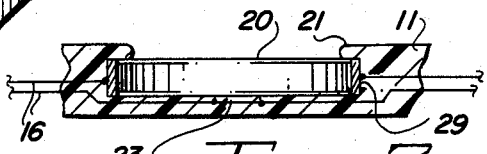
FIG. 7 is a view taken along lines 7—7 of FIG. 6.

The power source 20, typically a cylindrical low-profile battery, is contained within receiving means 22. The receiving means includes a first or base contact 23 and a cylindrical outer or second contact 24, shown in FIG. 6. One lead of each pair is connected to a particular light emitting diode and brought to the corresponding contact. The power source is press fit into the receiving means and, as shown in FIG. 7, retained by flange 21 overlying a portion of the power source. The flange is formed as an integral part of disc 11 and is capable of limited flexure.

The method of manufacture of these sport articles is typically by injection molding of plastic. The material used is flexible to increase the durability of the article since it repeatedly contacts the ground. As shown, flange 21 is formed integrally with the disc and flange members. At the time of molding, a jig containing a wire-pair configuration in the form of a spider is included within the mold and the material then enters therearound under pressure. In practice, the light emitting diodes are electrically connected to their corresponding wire-pair in the jig and located therein at the time of molding so as to become an integral part of the outer surface of flange 12. Thus, the present invention is especially well suited for rapid low cost manufacture of this type of sport article.

The location and position of the first and second contacts in receiving means 22 may likewise be formed as a portion of the jig with the electrical connections to the wire-pairs being made prior to the introduction of the material into the mold. As an alternative, the electrical contact mechanism can be later inserted and soldered connections made with the free ends of the wire-pairs.

In operation, the user grasps flange 12 by wrapping his fingers over thickened flange end 15 and tosses the sport object in a manner in which it is intended to reach another participant. As it travels, the flight characteristics of the object can be altered by the amount of spin and the direction of toss imparted by the user. As it rotates, the light emitting diodes 14 are moving thereby creating a line of light as the object moves toward the recipient. Since the light emitting diodes, the conductive pairs, the power source and associated electrical contacts are contained within the sport article itself, the inner surface contours of the article are not altered and thus do not effect the flight characteristics nor the ability of the recipient to grasp or field the tossed sport article. Similarly, the outer dimensions or surface contours of the sport article are uniform with the exception of the strengthening of the central region 17 as shown by its increased thickness which accomodate the power source 20 and the overlying flange 21. However, this does not materially alter the flight characteristics of the sport article since the thickening occurs at the central region which is at or proximate to the axis of rotation of the sport article in flight.

While the above description has referred to a specific embodiment of the invention, it is recognized that many variations and modifications may be made therein without departing from the scope of the invention as claimed.

What is claimed is:

1. A sport article for tossing about by hand, which comprises:

(a) a disc having a central region and a perimetric region therearound;

(b) flange means depending from said perimetric region, said flange means including inner-facing and outer-facing surfaces;

(c) receiving means located in said central region for removably receiving a power source therein, said receiving means having a base and an adjacent wall member;

(d) first and second contact means located in said receiving means, said first contact means being located at the base thereof and said second contact means being located in the adjacent wall member;

(e) retention means located on the outer surface of the central region of said disc for securing the power source in said receiving means, said retention means including a flexible flange formed as an integral portion of the central region of said disc, said flange overlying a portion of the receiving means;

(f) light emitting means positioned within said flange means proximate to the outer-facing surface thereof; and (g) connection means contained within said disc and flange means for electrically connecting said light emitting means to said receiving means; the placement of a power source in said receiving means causing light to be emitted from the outer surface of said flange means.

2. The invention of claim 1 wherein said light emitting means is an integral portion of the outer-facing region of said flange means.

3. The invention of claim 2 wherein said light emitting means comprises a plurality of light emitting diodes spaced within the said flange means.

4. The invention of claim 3 wherein said connection means comprises a plurality of conductor pairs contained within the disc and flange means, each of said pairs extending between the first and second contact means and a light emitting diode to provide an unbroken inner-surface of said sport article.

* * * * *